United States Patent [19]

Howard et al.

[11] Patent Number: 4,741,791

[45] Date of Patent: May 3, 1988

[54] FLOCKED TRANSFER MATERIAL AND METHOD OF MAKING HEAT-TRANSFERABLE INDICIA THEREFROM

[75] Inventors: Arthur F. Howard, Sudbury; Philip K. So, Dedham, both of Mass.

[73] Assignee: Bemis Associates Inc., Watertown, Mass.

[21] Appl. No.: 887,248

[22] Filed: Jul. 18, 1986

[51] Int. Cl.[4] ..... B32B 5/00

[52] U.S. Cl. ..... 156/72; 156/230; 156/234; 156/235; 156/237; 156/239; 156/240; 428/90

[58] Field of Search ..... 428/90; 427/146, 200, 427/206; 156/72, 230, 234, 235, 237, 239, 240

[56] References Cited

U.S. PATENT DOCUMENTS

| | | | |
|---|---|---|---|
| 4,142,929 | 3/1979 | Otomine | 428/90 |
| 4,201,810 | 5/1980 | Higashiguchi | 428/90 |
| 4,273,817 | 6/1981 | Matsuo | 428/90 |
| 4,282,278 | 8/1981 | Higashiguchi | 428/90 |
| 4,314,813 | 2/1982 | Masaki | 8/468 |
| 4,396,662 | 8/1983 | Higashiguchi | 428/90 |

*Primary Examiner*—Marion E. McCamish
*Attorney, Agent, or Firm*—Cesari and McKenna

[57] ABSTRACT

A flocked transfer material for attachment to a fabric or other material comprises a release sheet. As the transfer material is cut into a preselected pattern, the release sheet holds unconnected portions of the pattern in the correct relative positions such that the entire pattern may be directly applied to a surface with precise registration in a single-step process.

6 Claims, 1 Drawing Sheet

FLOCKED TRANSFER MATERIAL AND METHOD OF MAKING HEAT-TRANSFERABLE INDICIA THEREFROM

BACKGROUND OF THE INVENTION

This invention relates to "flocked" transfer material which may be adhered to a variety of fabrics or other materials by a heat sealing process. Flocked transfer material is widely used for alphanumeric symbols and decorative designs which may be applied to shirts, caps and similar articles.

A major difficulty with the application of transfer material is achieving precise positioning or registration of the indicia with respect to the surface to which they are attached. For example, in order to transfer a six-letter name on the back of a shirt, the alignment and spacing of each letter must be done by hand, which creates a significant chance for error or nonuniformity. In addition, there is always the possibility that some portion of the design may be lost or separated, thereby rendering the entire design unusable.

Another problem associated with flocked transfer materials is unwanted variations in color between materials which are dyed in different lots. The variations can become quite noticeable, possibly to the extent that the appearance is unacceptable to the user.

SUMMARY OF THE INVENTION

The present invention provides a composite flocked transfer material and method of manufacturing the same. The material may be formed into a wide variety of indicia, including alphanumeric characters and decorative designs, which may be attached to fabric or the like by a heat sealing process.

The composite material comprises a first release sheet which includes a film of strong-bonding material. A layer of flock material is then applied to the bonding film. A second release sheet or temporary backing sheet is then lightly adhered to the layer of flock material. Subsequently, the first release sheet is removed thereby exposing the film of strong-bonding material.

The resulting composite flocked transfer material may then be die-cut by machine into a preselected pattern. Precise control of the depth of cut may produce the desired pattern while leaving the temporary backing sheet intact. Thus, the backing sheet serves to retain unconnected portions of the die-cut pattern in their proper relative positions for subsequent permanent attachment to a fabric surface or the like. Once the permanent attachment is completed by a conventional heat sealing process, the temporary backing sheet may be peeled away to reveal the underlying pattern. Since an entire pattern may be cut from a single lot of dyed material, unwanted color variations may be substantially reduced.

BRIEF DESCRIPTION OF THE DRAWINGS

This invention is pointed out with particularity in the appended claims. The above and further advantages of this invention may be better understood by referring to the following description taken in conjunction with the accompanying drawings, in which:

DETAILED DESCRIPTION OF AN ILLUSTRATIVE EMBODIMENT

Figure 1:
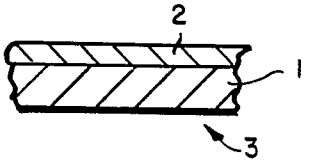
FIG. 1 PRIOR ART
FIG. 1 is a cross-sectional view of a release sheet known in the prior art.

FIG. 1 is a cross-sectional view of a backing or release sheet 3 which comprises a paper layer 1 coated on one side with a thin release layer 2 of a weak-bonding material. The release layer 2 may comprise, for example, polyethylene of a thickness providing a basis weight of 13 pounds per ream.

In general, the function of the release sheet 3 is to provide a stable "substrate" upon which a desired transfer material may be constructed. Once manufacturing is complete, the release sheet 3 detaches quickly and easily from the transfer material by virtue of the release layer 2 and its weak bonding charcteristic.

Figure 2:
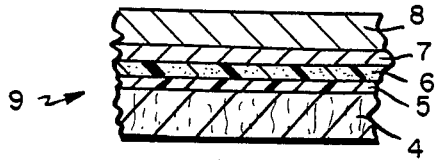
FIG. 2 is a cross-sectional view of a flocked sheet used in the invention.

FIG. 2 is a cross-sectional view of a flocked sheet 9 constructed on a release sheet comprising a release layer 7 and a paper layer 8. The release layer 7 and the paper layer 8 may be similar to those shown in FIG. 1. Alternatively, the release layer 7 may comprise a layer of silicone release material. A film 6 of strong-bonding material is cast on the release layer 7. Subsequently, a layer 5 of liquid flocking adhesive is applied to the film 6, followed by a flock layer 4, using conventional flocking techniques known in the prior art.

The film 6 may be of, for example, a thermoplastic bonding material such as a vinyl chloride-vinyl acetate coploymer. The film 6 may alternatively be of a modified polyester adhesive or other film adhesive. As described in detail below, the melting point of the release layer 2, shown in FIG. 1, should be higher than that of the film 6 in order to permanently attach the flock layer 4 to a desired surface in the proper manner. Flock layer 4 may comprise any of a number of commercially available synthetic or other fibers.

Figure 3:
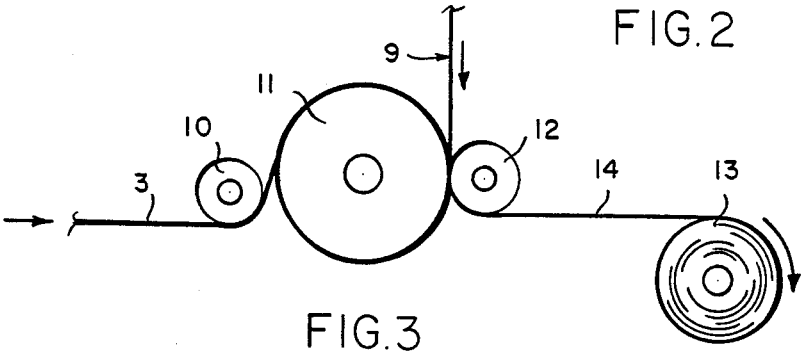
FIG. 3 is a diagram illustrating the preferred embodiment of a method of manufacturing a composite flocked transfer sheet in accordance with the present invention.

The release sheet 3 shown in FIG. 1 and the flocked sheet 9 shown in FIG. 2 may be combined into a composite flocked transfer sheet. Referring now to FIGS. 1, 2 and 3, a web of the release sheet 3 is guided by a roller 10 to a heated drum 11. The release sheet 3 is oriented such that the release layer 2 faces outward and is not in contact with the surface of the drum 11. The drum 11 heats the release sheet 3 to a temperature of approximately 300° F. This temperature is sufficient to make the weak-bonding material of release layer 2 slightly tacky.

After passing around the drum 11, the sheet 3 passes through a nip between the drum 11 and a pressure roller 12. A web of the flocked sheet 9 is simultaneously guided through the nip and is oriented such that the flock layer 4 contacts the tacky release layer 2. The release sheet 3 is thus lightly bonded to the flocked sheet 9. The result of this bonding is a composite flocked transfer material 14, which is collected on a takeup reel 13.

The bonding of the release sheet 3 and the flocked sheet 9 is done under controlled temperature and pressure such that the bond formed between the release layer 2 and the flock layer 4 is relatively weak. In contrast, as described below, when the flock layer 4 is subsequently permanently attached to a desired surface by a heat transfer process, a relatively strong bond is formed between the surface and the flock layer 4.

Once the composite flocked transfer material 14 has cooled sufficiently, the release sheet comprising the release layer 7 and the paper layer 8 is removed and set aside for reuse. As may be seen in FIG. 4, which is inverted with respect to FIGS. 1 and 2, the film 6 (strong-bonding material) is exposed after the removal of the release layer 7 and the paper layer 8. The removal of the release layer 7 and the paper layer 8 is a one-step process of simply "peeling" the paper away since the release layer 7 adheres much more strongly to the paper layer 8 than to the film 6. In other words, the paper layer 8 and the layer 7 are "releasing" in the characteristic manner of a release sheet to leave a flocked transfer material 15 bonded to the release sheet 3.

Figure 4:
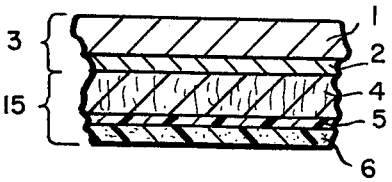
FIG. 4 is a cross-sectional view of the preferred embodiment of a composite flocked transfer sheet constructed in accordance with the present invention.
Figure 5:
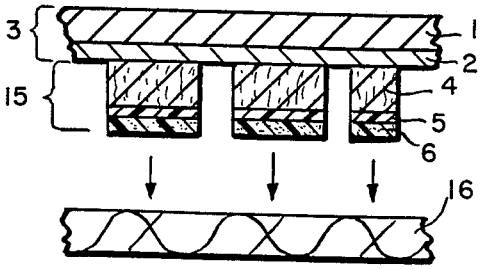
FIG. 5 is a cross-sectional view of the sheet in FIG. 4 which has been die-cut to provide a preselected design.

The flocked transfer material 15 is shown in FIG. 4 may be subsequently die-cut into desired alphanumeric symbols, ornamental or other indicia as shown in FIG. 5. Computer-controlled machinery may be used to precisely control the depth of cut thereby leaving the release sheet 3 intact while removing unwanted portions of the flock layer 4, layer 5 and film 6. The significance of the intact release sheet 3 is that unconnected portions of the die-cut pattern, which would otherwise separate into loose pieces, are held together in proper relative positions for subsequent transfer to a desired surface such as a fabric 16. Release sheet 3 is thus effective in preventing loss of portions of the die-cut pattern as well as misalignment during subsequent application.

Flocked transfer material 15 is subsequently permanently bonded to the fabric 16 by a combination of heat and pressure in a conventional heat sealing process known in the prior art. In general, the flocked transfer material 15 is laid flat on the fabric 16 and compressed for a preselected time at a preselected temperature. The duration and temperature of the compression are such that the strong-bonding thermoplastic material (film 6) melts and flows freely into intimate contact with the fibers of the fabric 16. As referred to above, the melting point of the release layer 2 (weak-bonding material) should be higher than that of the film 6 (strong-bonding material) so that only the film 6 will melt and form a permanent bond during the heat sealing process.

Figure 6:
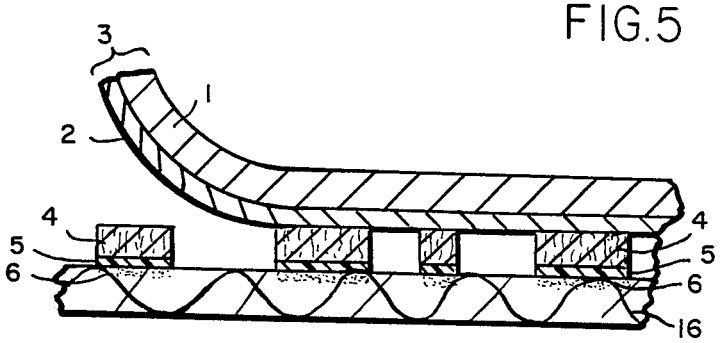
FIG. 6 is a cross-sectional view of the material in FIG. 5 subsequent to permanent attachment of the material to a fabric surface.

As may be seen in FIG. 6, the film 6 has melted and partly dispersed into the fibers of the fabric 16. The flock layer 4 is now permanently bonded to the fabric 16 and the release sheet 3 may be easily and quickly peeled away to reveal the underlying design.

The foregoing description has been limited to a specific embodiment of this invention. It will be apparent, however, that variations and modifications may be made to the invention, with the attainment of some or all of the advantages of the invention. Therefore, it is the object of the appended claims to cover all such variations and modifications as come within the true spirit and scope of the invention.

What is claimed as new and desired to be secured by Letters Patent of the United States is:

1. A method of making a flocked transfer material for attachment to fabric or the like, said method comprising the steps of:

(1) applying a layer of strong-bonding material to the coated side of a first release sheet which has one side coated with a release material;

(2) applying a layer of flock material to the layer of strong-bonding material;

(3) applying a layer of flock material to the layer of flock adhesive;

(4) attaching a second release sheet to the layer of flock material, said second release sheet having one side coated with a release material with a higher melting point than that of said strong-bonding material, wherein the attaching of the second release sheet comprises the steps of:

(a) heating the second release sheet to a temperature above the tackifying temperature of said release material; and (b) pressing the coated side of the heated second release sheet against the layer of flock material; and (5) peeling the first release sheet from the layer of strong-bonding material.

2. The method of claim 1 wherein:

said heating step comprises passing the second release sheet over the surface of a heated drum, with the coated side of the release sheet away from the drum surface, and said pressing step comprises passing the heated second release sheet and the flock layer coated sheet through a nip between said heated drum and a pressure roller, with said second release sheet still in contact with the heated drum, and with said flock layer and said coated side of the second release sheet in face-to-face contact.

3. The method of claim 1 wherein said strong-bonding material comprises a vinyl chloride-vinyl acetate copolymer.

4. The method of claim 1 further comprising, after said peeling step, the step of die-cutting the flocked transfer material into a preselected pattern.

5. The method of claim 4 wherein said die-cutting includes cutting through said strong-bonding-material layer and said flock-adhesive layer, and leaving said second release sheet substantially intact, whereby the components of said preselected pattern are held together by said intact release sheet.

6. The method of claim 5 further comprising the step of applying said die-cut material to a substrate of a fabric or the like, said applying step comprising:

(1) placing the die-cut material on the substrate with the strong-bonding adhesive facing the substrate;

(2) heating and compressing said material against said substrate at a temperature and pressure and for a duration sufficient to cause said strong-bonding material to melt and flow into said substrate, said temperature being above the melting point of said strong-bonding adhesive and below the melting point of the release material of said second release sheet;

(3) allowing said strong-bonding to cool below its solidifying point; and (4) peeling said second release sheet off said flock layer, thereby leaving the preselected pattern of flocked material bonded to the substrate.

* * * * *